US005596800A

United States Patent [19]

Holliday et al.

[11] Patent Number: 5,596,800

[45] Date of Patent: Jan. 28, 1997

[54] CRIMPING TOOL WITH RATCHET MECHANISM

[75] Inventors: Randall A. Holliday, Westminster; Donald Kesinger, Morrison, both of Colo.

[73] Assignee: Cable Ready, Inc., Denver, Colo.

[21] Appl. No.: 378,971

[22] Filed: Jan. 26, 1995

Related U.S. Application Data

[63] Continuation-in-part of Ser. No. 992,524, Dec. 17, 1992, abandoned, and a continuation-in-part of Ser. No. 218,624, Mar. 28, 1994, Pat. No. 5,392,508.

[51] Int. Cl.[6] ..... H01R 43/042

[52] U.S. Cl. ..... 29/751; 29/753; 29/758; 7/107; 72/409.01; 72/409.14; 81/313; 81/314

[58] Field of Search ..... 29/268, 280, 282, 29/750, 751, 753, 758, 861, 862, 863; 7/107; 72/409.01, 409.06, 412, 416, 409.08, 409.1, 409.14; 81/313, 314, 355, 356, 357

[56] References Cited

U.S. PATENT DOCUMENTS

| | | | |
|---|---|---|---|
| 2,985,047 | 5/1961 | Van Oort | 81/313 X |
| 3,156,139 | 11/1964 | Willis | 81/313 X |
| 3,199,336 | 8/1965 | Batcheller | 81/313 X |
| 3,322,008 | 5/1967 | Filia | 81/313 |
| 3,417,599 | 12/1968 | Burns | 72/409.08 |
| 4,043,174 | 8/1977 | Paolino | 72/412 |
| 4,062,218 | 12/1977 | Wiener | 81/314 |
| 4,266,419 | 5/1981 | Grandfest | 72/409.1 X |
| 4,292,833 | 10/1981 | Lapp | 72/416 |
| 4,742,737 | 5/1988 | Hatfield | 81/355 |
| 4,765,176 | 8/1988 | Geisser | 29/751 X |
| 4,790,068 | 12/1988 | Sato | 29/761 |
| 4,794,780 | 1/1989 | Battenfield | 72/409.01 |
| 4,885,928 | 12/1989 | Davis et al. | 72/407 X |
| 4,953,384 | 9/1990 | Baillet et al. | 72/409.06 |
| 5,094,097 | 5/1992 | Tooth et al. | 29/751 X |
| 5,138,864 | 8/1992 | Tarpill | 29/751 X |

FOREIGN PATENT DOCUMENTS

| | | | |
|---|---|---|---|
| 735642 | 6/1966 | Canada | 81/314 |
| 58375 | 8/1982 | European Pat. Off. | 81/314 |
| 2149167 | 4/1973 | Germany | 29/751 |
| 49114 | 3/1965 | Poland | 29/751 |

*Primary Examiner*—Peter Vo
*Attorney, Agent, or Firm*—John E. Reilly

[57] ABSTRACT

A crimping tool for connecting a cable fitting to the end of a coaxial cable is made up of one or more die members having tapered die surfaces, a chuck which is axially spaced from the die surfaces to support the fitting in loosely assembled relation to the end of the cable, and a handle operates through a ratchet mechanism to cause axial movement of the chuck toward and away from the die surfaces and axially force the fitting into the die cavity so as to uniformly reduce the circumference of one end of the fitting into a generally conical configuration snugly engaging the cable.

20 Claims, 2 Drawing Sheets

CRIMPING TOOL WITH RATCHET MECHANISM

Cross-Reference to Related Applications

This application is a continuation-in-part application of Ser. No. 992,524, filed 17 Dec., 1992, now abandoned, for CRIMPING TOOL by Randall A. Holliday and Donald Kesinger and Ser. No. 218,624, filed 28 Mar., 1994, now U.S. Pat. No. 5,392,508 or CRIMPING TOOL by Randall A. Holliday and Donald Kesinger.

Specification

This invention relates to crimping or swaging devices and more particularly relates to a novel and improved tool for compressing fittings into uniform sealed engagement with cable ends, such as, bicycle cables and coaxial cables used in the television industry.

BACKGROUND AND FIELD OF INVENTION

It has been the practice in the television industry to employ a hand-held crimping tool to attach the standard fitting onto the end of a coaxial cable, and the fitting can then be threadedly connected into the mated fitting or terminal on the television set. Presently, crimping tools are designed to crimp or reduce the size of the connector sleeve on the cable side of the fitting into a generally hexagonal or six-sided configuration in attaching the fitting to the end of the cable. A major problem with the hexagonal crimp, however, is that it does not completely seal off the end of the cable and permits air and moisture to enter by way of the cable end which can affect the quality of the picture and gradually erode the cable itself.

It has been proposed to radially compress fittings into a generally circular configuration and, for example, reference is made to U.S. Pat. No. 5,138,864 to A. J. Tarpill which is designed specifically for use in radially compressing ribbed connector sleeves and wherein the axial length of the connector sleeve is uniformly reduced in diameter to a size which will engage the cable end. Other patents of interest in this field are U.S. Pat. Nos. 3,417,599 to W. C. Burns, 4,043,174 to A. J. Paolino, 4,266,219 to M. A. Grundfest, 4,292,833 to E. W. Lapp, 4,790,068 to K. Sato, 4,794,780 to K. Battenfeld, 4,885,928 to E. H. Davis et al and 4,953,384 to A. Baillet et al.

In applying an axially directed force to the fitting, as opposed to direct radial compression, it has been found that leverage can be substantially improved through the use of a ratchet mechanism while at the same time reducing the range of motion or throw of the lever arm compared to that of a straight lever action to the connector-engaging member.

SUMMARY OF INVENTION

It is therefore an object of the present invention to provide for a novel and improved device which is specifically adaptable for use in compressing a fitting onto the end of a cable, such as, bicycle cables or coaxial cables.

It is another object of the present invention to provide for a novel and improved hand-held portable tool for crimping or swaging hollow cylindrical sleeve portions into sealed engagement with the end of a cable.

It is a further object of the present invention to provide in a tool for a novel and improved means of controlling the movement of a force-applying member against a sleeve portion to be compressed or shaped to engage a cable end and be conformable for use in attaching a wide range of different diameter sleeve portions into uniform sealed engagement with a cable.

In accordance with the present invention, a novel and improved device has been devised for connecting a cable fitting having a generally tubular connector sleeve to an and of a coaxial cable wherein the sleeve is composed of a thin-walled deformable material and wherein the device comprises a die member defining a tapered cavity, carrier means axially spaced from the cavity for supporting the sleeve in facing relation to the first end of the cavity when the cable end is extended through the cavity and at least partially inserted into the sleeve, a handle, support means pivotally mounting the handle for axial movement of the carrier toward and away from the die whereby to force the sleeve axially into the cavity under sufficient force to radially contract the sleeve into a tapered configuration corresponding to that of the cavity and force multiplier means for multiplying the amount of force applied by the carrier means to the sleeve and the extent of axial movement of the sleeve toward the die member.

Preferably, the force multiplier means is in the form of a compact ratchet mechanism between the carrier means and support means to regulate the axial movement of the carrier means under the control of the handle associated with the support means in forcing the sleeve axially into engagement with the dies.

The above and other objects, advantages and features of the present invention will become ore readily appreciated and understood from a consideration of the following detailed description of preferred and modified forms of the present invention when taken together with the accompanying drawings in which:

DETAILED DESCRIPTION OF PREFERRED EMBODIMENT

Figure 1:
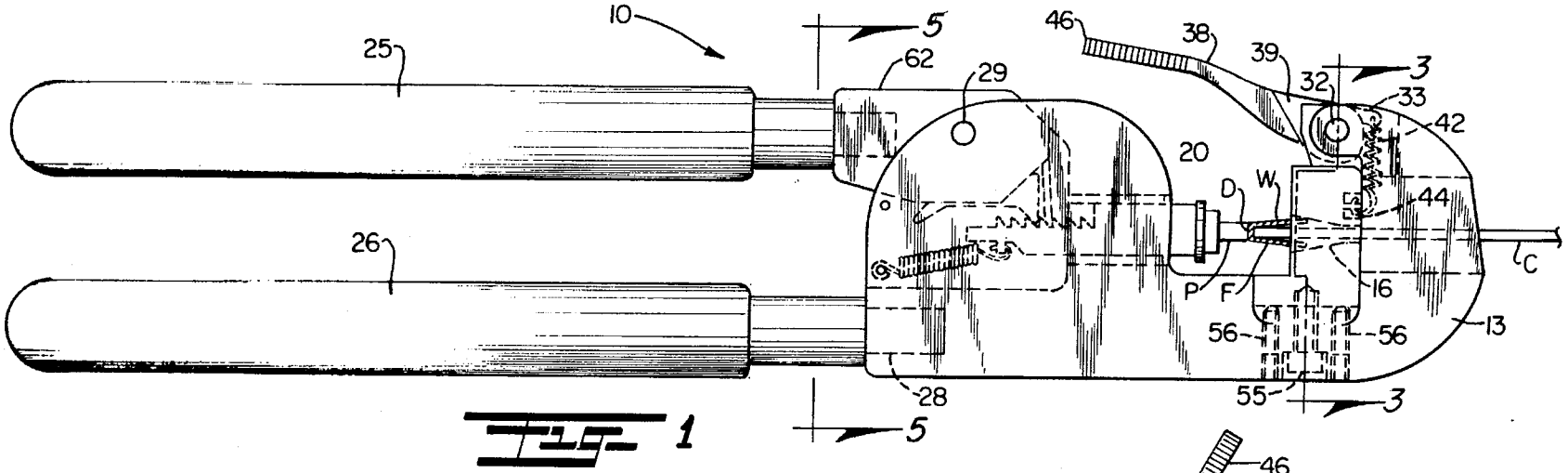
FIG. 1 is a side view in elevation of a preferred form of tool in accordance with the present invention.
Figure 3:
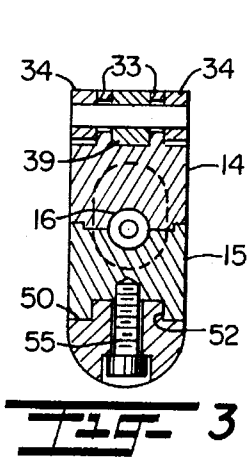
FIG. 3 is a cross-sectional view taken about lines 3—3 of FIG. 1.
Figure 2:
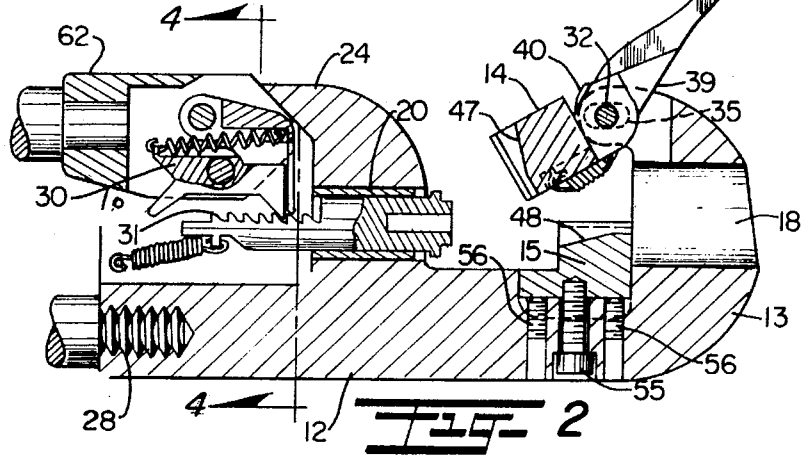
FIG. 2 is a fragmentary side view partially in section of the preferred form illustrated in FIG. 1.
Figure 5:
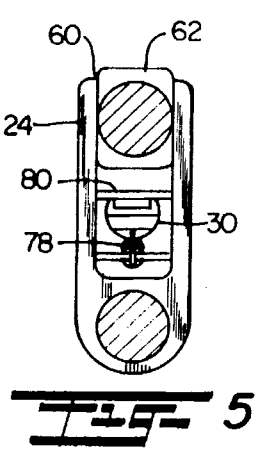
FIG. 5 is a cross-sectional view taken about lines 5—5 of FIG. 1.
Figure 4:
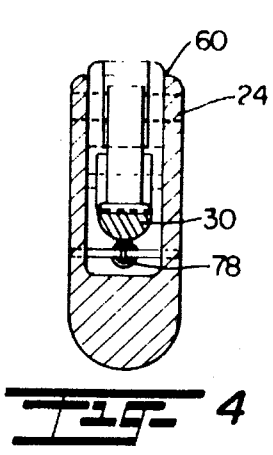
FIG. 4 is a cross-sectional view taken about lines 4—4 of FIG. 2.

Referring in more detail to the drawings, there is illustrated in FIGS. 1 to 4 a preferred form of hand-held tool 10. For the purpose of illustration, the tool is shown in FIGS. 1 and 2 in operative relationship to a standard fitting F to be attached by swaging onto one end of a bicycle cable C so that the cable C can then be attached to the brake control lever or gear control mechanism of the bicycle. In this setting, the fitting F is typically in the form of a hollow cylindrical member closed at one end as designated at D and a wall section W which is slightly tapered in a direction toward the closed end D. The cable C, in accordance with conventional practice, is inserted into the fitting F and the fitting F then swaged by radially contracting the wall section W uniformly into tight-fitting, fitting, surrounding relation to the cable end. In this respect, the radial contraction is caused by the application of axial force to the fitting F in a manner to be described. It is to be understood that the following description of the tool 10 in swaging the fitting F onto the cable C is given more as a setting for the present invention, and that the tool is readily conformable for use in other applications as well.

The preferred form of crimping tool 10 is broadly comprised of a common base or body portion 12 having a die support end 13 to receive split die portions 14 and 15 which define a common tapered cavity 16 therebetween and in communication with an opening 18 which is formed through the end of the body 12. A carrier 20 is in the form of a generally cylindrical chuck which is slidably disposed within an opening of a support block 24 at one end of the base 12 axially spaced from the die portions 14 and 15. The carrier 20 is so positioned as to be axially spaced from but in alignment with the axis of the cavity 16. A pair of handles 25 and 26 extend away from the one end of the body 12 at an acute angle to one another, the lever arm 26 being attached as at 28 in fixed relation to the end of the base 12, and the member 25 being pivotally attached by pivot pin 29 to an upper portion of the support block with a ratchet pawl 30 engageable with ratchet teeth 31 on the carrier 20 to cause the carrier to be forced in an axial direction between the position shown in FIG. 2 and that shown in FIG. 1. As described, preferably the die support end 13 and axially spaced chuck support end 24 are of unitary construction with the common base 12.

In order to permit extension of the fitting F and cable C into position between the die support end 13 and the support block 24, the upper die portion 14 is pivotally mounted by pivot pin 32 for vertical movement of the die portion 14 through a slot in the upper end of the support portion 13 between a closed position as illustrated in FIG. 1 and an open position as illustrated in FIG. 2.

The die portion 14 has a bifurcated extension 33 which is inserted between spaced bosses 34 at the upper end of the die support end 13. A closed slot 35 in the extension 33 is aligned with openings in the bosses 34 for insertion of the pin 32 to permit combined pivotal and sliding movement of the die portion 14 about the pin 32. A toggle arm 38 has a connecting end 39 which is inserted into the bifurcated extension 33 and is also pivotal about the pin 32.

The die portion 14 is biased in an upward direction under the urging of a coil spring 42 which extends through a slot 44 in the rear surface of the die portion 14, the spring having an upper end anchored to one end of the extension 33 and a lower end anchored to the lower end of the slot 44. When the arm 38 is in an open or raised position, the urging of the spring 42 will cause the die portion 14 to be retracted against the rounded undersurface portion of the extension 39 at the least distance away from the opening in the extension for the pivot pin 32, and the pivot pin 32 is also free to slide through the closed slot in retracting the die portion 14 under the urging of the spring 42. When the toggle arm 38 is pivoted toward the closed position, the die portion 14 is caused to abut the end wall of the die support end 13 which surrounds the cavity 16 prior to the end of travel of the arm 38, and continued pivotal movement of the arm 38 will then cause a cam surface 40 on the extension 38 to slide along the upper surface of the die portion and by virtue of the increasing thickness or distance of the cam surface 40 from the opening in the extension 38 for the pin 32 will cause the die portion 14 to slide downwardly toward the lower die portion 15 against the urging of the spring 42.

The arm 38 is tapered slightly in a direction away from the end 39 and terminates in a free end 46 which bears against the support block 24 when it reaches the closed position. The die portions 14 and 15 have die surfaces 47 and 48, respectively, of generally semi-conical configuration, and complementary ribs 50 and grooves 52 on confronting surfaces of the die portions 14 and 15, respectively, will interengage with one another as the die portion 14 is advanced into the closed position with respect to the die portion 15.

The lower die portion 15 has a threaded counterbore aligned with a throughbore in the base to receive a bolt 55. In order to permit adjustable mounting of the die portion 15, Allen head screws 56 are inserted in bores on opposite sides of the bolt 55 to bear against the bottom surface of the die portion 15 so that the die portion 15 can be adjusted in a direction toward and away from the die portion 14 and be locked firmly in place. This fine adjustment for the lower die portion 15 assures that the proper clearance and alignment is provided between the die portions 14 and 15 when the arm 38 causes the upper die portion 14 to move into engagement with the lower die portion 15 and will effectively compensate for the use of different sized dies.

The support block 24 forms an upright extension of the base 12 and is provided with an open vertical slot 60 for insertion of a pivotal end 62 of the handle 25. The pivot pin 29 extends through the support block 24 and through an aligned opening in the end 62 to pivotally mount the handle 25 for rotation with respect to the support block 24. In addition, a detent 64 of generally elbow-shaped configuration includes an upper leg 65 provided with an aligned opening for insertion of the pivot pin 29 and a lower leg 66 which extends vertically or downwardly from the upper leg and terminates in a beveled end 67 for insertion between the ratchet teeth 31 on the carrier 20. A force-multiplying member includes the ratchet pawl 30 disposed within the slotted end 60 of the support block and pivotally secured within the slotted portion 60 of the block 24. The ratchet pawl 30 is pivotally secured at 68 only to the handle 25 and not to the support block 24 so as to be free to rotate with the pivotal end 62 about the pivot 29 as well as to be pivotal about pin 68 with respect to the pivotal end 62. The ratchet pawl 30 includes a forward, vertically directed dog 72 and a rearward inclined dog 73, the dog 72 being movable into engagement with the ratchet teeth 31 under the urging of a coiled spring member 74, the latter extending between a pin 75 on the holding pawl or detent 64 and retainer 76 at the upper rearward edge of the ratchet pawl 70. The spring 74 is mounted under tension so as to bias the detent 64 and upper end of the ratchet pawl 30 toward one another. Furthermore, the carrier 20 is biased rearwardly by a tension spring 78 so as to urge the carrier 20 into a retracted position away from the die members 14 and 15.

Figure 8:
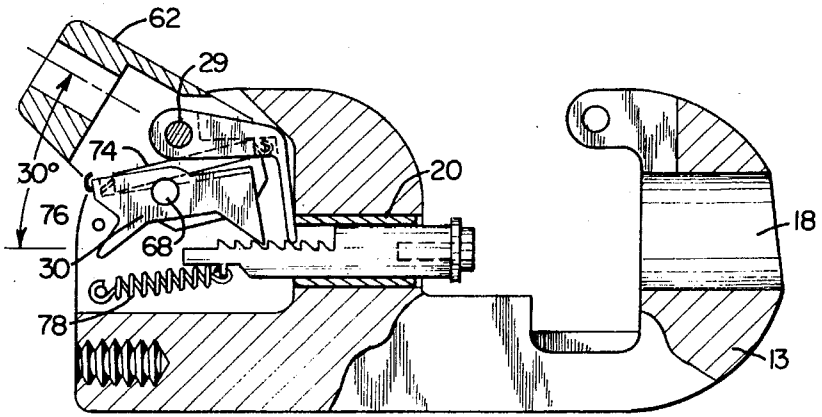
FIGS. 6 to 9 are cutaway views illustrating successive advancement and release of the ratchet mechanism in a crimping or swaging operation.
Figure 7:
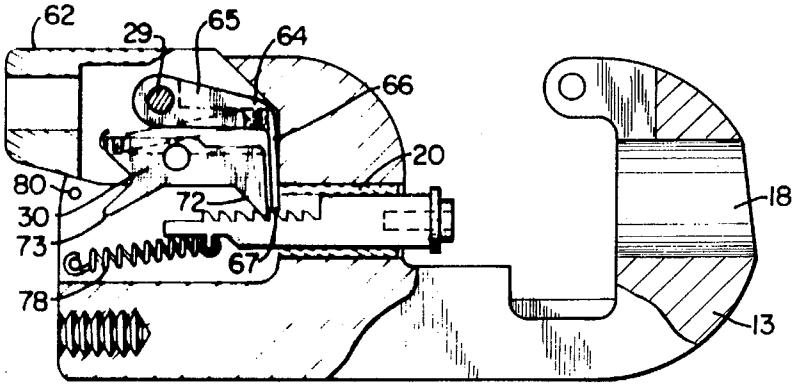
Figure 6:
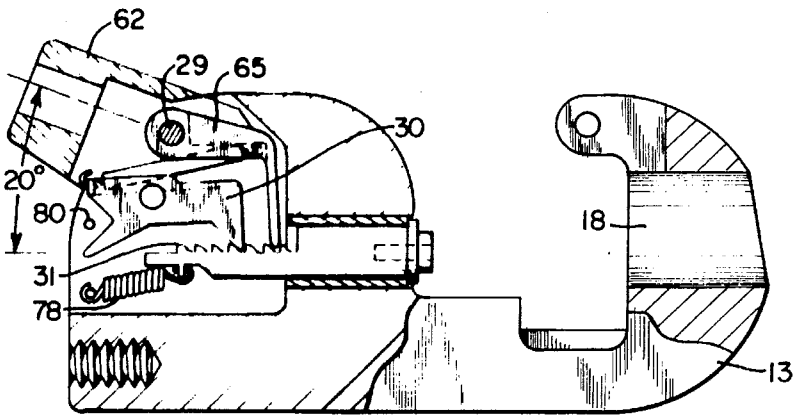

FIGS. 3, 3A, 3B and 3C illustrate the cooperative disposition and relationship between the detent 64 and ratchet pawl 30 when the handle 25 is pivoted toward and away from the fixed handle 26. This relationship may be best described, as shown in FIG. 1, for swaging the fitting F onto the cable end C. The fitting F is placed on the end of the cable C and passed through the aligned cavities 18 and 16 between the die members and advanced until the fitting F moves into engagement with a center pin P at the forward or leading end of the carrier 20. Initially, the carrier 20 is in its retracted position as shown in FIG. 6 with the dog 72 of the ratchet pawl 30 inserted between adjacent pairs of the ratchet teeth 31. When the movable handle 25 is pivoted from the position shown in FIG. 6 to that shown in FIG. 7, the ratchet pawl 70 is advanced forwardly by rotation about the pivot pin 29, and the dog 72 will force the carrier 20 toward the dies 14 and 15 an incremental amount or distance. The handle 25 is then raised as illustrated in FIG. 8 to cause the ratchet pawl 30 to rotate in a reverse direction and raise the dog 72 away from engagement with the ratchet teeth 31. However, the detent 64 remains in engagement with the ratchet teeth 31 and in fact is urged somewhat downwardly by the spring 74 to prevent rearward movement of the carrier 20 under the urging of the spring 78.

Figure 9:
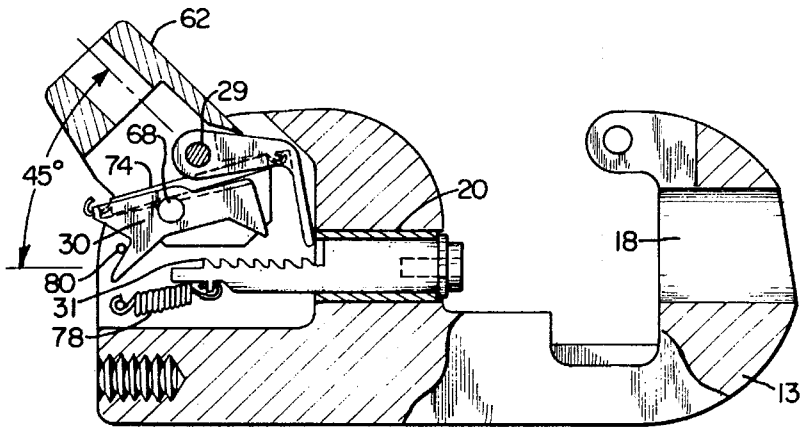

The handle 25 is once again pivoted toward the fixed handle 26 into the position as illustrated in FIG. 9 to cause the ratchet dog 72 to return into engagement with the next tooth in succession and advance the carrier 20 progressively toward the dies. The ratcheting operation is repeated the number of times necessary by reciprocating the handle 25 to cause the fitting F to enter between the closed dies 14 and 15 and be swaged onto the end of the cable. Once swaged, the handle 25 is raised away from the fixed handle 26, as shown in FIG. 9, until the upward cocking of the ratchet pawl 30 about the pin 29 together with engagement of the dog 73 with a pin 80 causes the detent 64 to be lifted away from the carrier 20 whereupon the return spring 78 will cause the carrier to be retracted to the initial or starting position shown in FIG. 6.

Among other advantages of the novel and improved tool 10 as described is the ability to achieve greater leverage through utilization of a ratchet mechanism than with the straight lever arm as described in my hereinbefore-referred to U.S. Pat. No. 5,392,508. The increased leverage in turn achieves greater application of force and enables use of the tool with larger end connectors. Furthermore, the movable handle requires a shorter stroke or throw owing to incremental advancement of the carrier than is possible with the straight lever arm principle as in my hereinbefore-referred to U.S. Patent and therefore is easier to grip and easier to use in close quarters.

The leading end of the plunger or carrier 20 is also designed and intended for use with end connectors or fittings of the type used on coaxial cables, as more fully set forth and described in my hereinbefore-referred to U.S. Pat. No. 5,392,508. Again, a particular advantage of the ratchet mechanism of the present invention is the additional leverage achieved and ability to crimp large connectors. All that is necessary for each different type or size of end connector or fitting F is to substitute different sized die portions 14 and 15 according to the size of fitting F to be crimped. The terms "swaging" and "crimping" are used interchangeably herein, "swaging" customarily being used in connection with bicycle cables and the term "crimping" customarily being used for attachment of end connectors onto coaxial cables but refer to the same procedure in radially contracting or shaping a hollow deformable end connector or fitting onto a cable or other member.

It is therefore to be understood that while a preferred embodiment of the present invention is herein set forth and described, the above and other modifications and changes may be made without departing from the spirit and scope of the invention as defined by the appended claims and reasonable equivalents thereof.

We claim:

1. A crimping device for connecting a cable fitting having a generally tubular connector sleeve to an end of a cable, said device comprising:

a die member defining a tapered cavity having a first diameter at a first end thereof substantially corresponding to an outer diameter of said sleeve and a second diameter axially spaced from said first diameter which substantially corresponds to an outer diameter of said cable end;

carrier means axially spaced from said cavity for supporting said sleeve in facing relation to said first end of said cavity with said cable end extending through said cavity and at least partially inserted into said sleeve;

support means mounting said carrier for axial movement toward and away from said die member; and force-multiplying means between said carrier means and said support means for multiplying the force applied to said sleeve and for regulating axial movement of said sleeve toward said die member whereby to force said sleeve axially into said cavity under sufficient force to radially contract said sleeve into a tapered configuration conforming with said tapered cavity of said die thereby to connect said sleeve to said end of said cable.

2. A crimping device according to claim 1, said force-multiplying means including ratchet and pawl members between said carrier means and said support means.

3. A crimping device according to claim 2, wherein a reciprocal member is mounted on said support means for advancing said pawl member into and out of engagement with said ratchet member.

4. A crimping device according to claim 3, wherein said reciprocal member is a pivotal said ratchet member is disposed on said carrier means, and said pawl member is pivotally secured to said handle.

5. A crimping device according to claim 2, wherein spring means yieldably urges said carrier means in an axial direction away from said die member.

6. A crimping device according to claim 2, wherein a detent engages said ratchet member to prevent retraction of said carrier means away from said die member.

7. A crimping device according to claim 6, wherein said detent is spring-loaded, and release means movable with said reciprocal member to release said detent from engagement with said ratchet member.

8. A crimping device according to claim 1, wherein said force-multiplying means is defined by a ratchet member on said carrier means and a pawl member on said support means, and a pivotal handle on said support means for advancing said pawl member into and out of engagement with said ratchet member.

9. A crimping device according to claim 8, said pawl member pivotally secured to said pivotal handle, a detent pivotally secured to said pivotal handle in spaced relation to said pawl member, and bias means yieldingly urging said detent into engagement with said ratchet member.

10. In a crimping device for connecting a cable fitting having a generally tubular connector sleeve to an end of a coaxial cable wherein said sleeve is composed of a thin-wall deformable material, a die member defining a cavity which substantially corresponds to a configuration and size necessary to compress said sleeve onto said cable end, carrier means in facing relation to a first end of said cavity, and support means mounting said carrier for axial movement toward and away from said die member whereby to force said sleeve axially into said cavity under sufficient force to radially compress said sleeve into a tapered configuration conforming with said cavity thereby to connect said sleeve to said end of said cable, the improvement comprising:

adjustable control means between said carrier means and said support means for adjustably controlling the amount of force applied to said sleeve and axial movement of said sleeve toward said die member.

11. In a crimping device according to claim 10, said adjustable control means including ratchet and pawl members between said carrier means and said support means.

12. In a crimping device according to claim 10, wherein a pivotal handle is mounted on said support means for advancing said pawl member into and out of engagement with said ratchet member, said ratchet member being disposed on said carrier means and said pawl member being pivotally secured to said handle.

13. In a crimping device according to claim 11, wherein a detent engages said ratchet member to prevent retraction of said carrier means away from said die member when said ratchet member is not engaged by said pawl.

14. In a crimping device according to claim 11, wherein spring means yieldably urges said carrier means in an axial direction away from said die member.

15. In a crimping device according to claim 13, wherein said detent is spring-loaded into engagement with said ratchet member, and release means movable with said handle to release said detent from engagement with said ratchet member.

16. In a crimping device according to claim 10, wherein said adjustable control means is defined by a ratchet member having a series of teeth on said carrier means and a pawl member on said support means, and a manually reciprocable member on said support means for advancing said pawl member into and out of engagement with said teeth.

17. In a crimping device according to claim 16, said pawl member pivotally secured to said reciprocal member, and a detent pivotally secured to said reciprocal member in spaced relation to said pawl member, and bias means yieldingly urging said detent into engagement with said teeth.

18. In a crimping tool for connecting a cable fitting to the end of a cable wherein a plurality of die members define tapered die surfaces at one end of said tool, a chuck axially spaced from said die surfaces to support the cable fitting in loosely assembled relation to the end of said cable, the combination therewith comprising:

a ratchet mechanism associated with said chuck having a series of axially spaced ratchet teeth; and reciprocal ratchet control means drivingly connected to said ratchet mechanism to successively engage said ratchet teeth and incrementally advance said chuck axially toward said die members under progressively increasing pressure wherein said fitting is forced into engagement with said die surfaces and radially contracted into snug engagement with said cable end.

19. In a crimping tool according to claim 18, wherein said ratchet mechanism includes a ratchet member on said chuck and a pawl member engageable with said ratchet control means whereby reciprocation of said ratchet control means causes said pawl member to advance into and out of engagement with said ratchet member.

20. In a crimping tool according to claim 19, wherein a detent engages said ratchet member to prevent retraction of said chuck away from said die surfaces when said ratchet member is not engaged by said pawl member.

* * * * *